US005157616A

United States Patent [19]

Haug

[11] Patent Number: 5,157,616

[45] Date of Patent: Oct. 20, 1992

[54] METHOD FOR FILLING THE VALVE QUANTITY MEMORY OF A FRANKING MACHINE

[75] Inventor: Werner Haug, Langnau, Switzerland

[73] Assignee: Frama AG, Lauperswil, Switzerland

[21] Appl. No.: 499,604

[22] Filed: Mar. 26, 1990

[30] Foreign Application Priority Data

Mar. 29, 1989 [CH] Switzerland ..... 193/89

[51] Int. Cl.[5] ..... G07B 17/00

[52] U.S. Cl. ..... 364/464.02; 235/382; 235/382.5

[58] Field of Search ..... 235/382, 382.5; 364/464.02

[56] References Cited

U.S. PATENT DOCUMENTS

| | | | |
|---|---|---|---|
| 4,097,923 | 6/1978 | Eckert, Jr. et al. | 364/900 |
| 4,520,725 | 6/1985 | Haug | 101/110 X |
| 4,788,623 | 11/1988 | Haug | 361/171 |
| 4,807,139 | 2/1989 | Liechti | 364/464.02 |
| 4,898,093 | 2/1990 | Haug | 101/110 X |
| 5,077,660 | 12/1991 | Haines et al. | 364/464.02 |
| 5,077,792 | 12/1991 | Herring | 380/24 |
| 5,079,712 | 1/1992 | Ileana et al. | 364/464.02 X |

*Primary Examiner*—Parshotam S. Lall
*Assistant Examiner*—Edward R. Cosimano
*Attorney, Agent, or Firm*—Ladas & Parry

[57] ABSTRACT

For filling the value preset memory (20) of a franking machine, a return code is released by the franking machine's read-only memory (21). This return case must be provided to an authorizing central room or station together with the value quantity to be filled in order to receive therefrom an input code permitting the filling of the value preset memory with said amount. The control room and the ROM (21) of the franking machine store in tabular form numerous information pairs comprising an input code and a return code. These codes comprise eight random numbers. By entering the input code in the franking machine, a program in the central electronic control unit of the franking machine causes a search of the control unit's ROM (21) for the table location of an identical, true random number. After establishing this identity, the value preset memory (20) is filled with a predetermined value quantity corresponding to the table and the return code, associated in tabular manner with the final input code and the necessary for future filling operations, is outputted.

19 Claims, 5 Drawing Sheets

CODE TABLE FOR FRANKING MACHINE SERIAL NO. 143876

OWNER: WALTER SCHMID, HAUPTSTR. 7, SAFENWIL

| C- Fr. 100 | ISSUE DATE | Vi | C- Fr. 200 | ISSUE DATE | Vi | C- Fr. 500 | ISSUE DATE | Vi |
|---|---|---|---|---|---|---|---|---|
| 11445378 | 16.11.87 | Te | 12613259 | | | 13441176 | 28.12.87 | Te |
| 21379432 | 28.12.87 | Te | 22770833 | | | 23490039 | | |
| 11152647 | | | 12023041 | | | 13895899 | | |
| 21299595 | | | 22912418 | | | 23662641 | | |
| 11269736 | | | 12476040 | | | 13417620 | | |
| 21414634 | | | 22722163 | | | 23168207 | | |
| 11074766 | | | 12516059 | | | 13312056 | | |
| 21325227 | | | 22264525 | | | 23481060 | | |
| 11471841 | | | 12270769 | | | 13626224 | | |
| 21249809 | | | 22653526 | | | 23717250 | | |

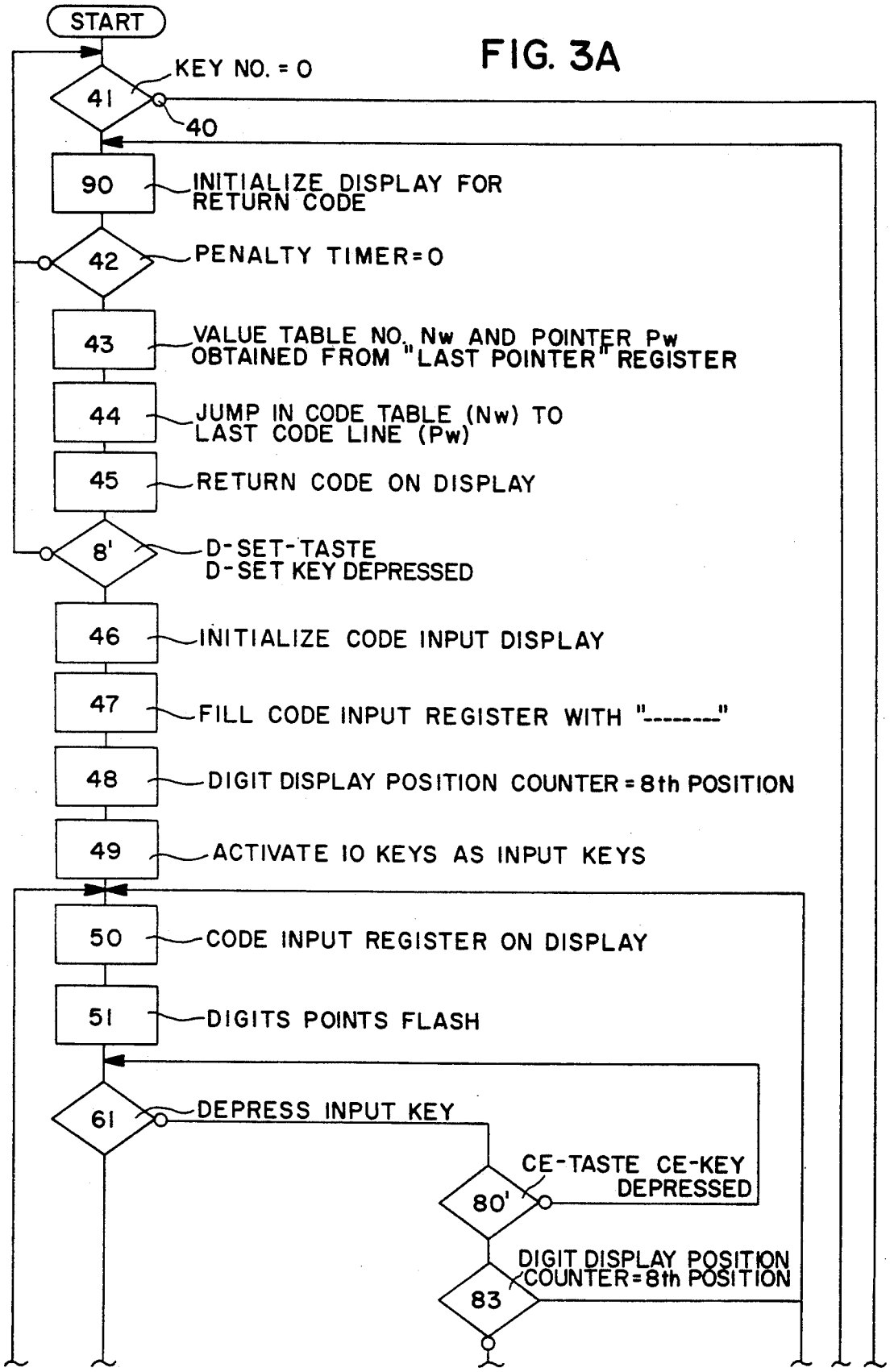
START
FIG. 3A
KEY NO. = 0
41
40
90
INITIALIZE DISPLAY FOR RETURN CODE
42
PENALTY TIMER=0
43
VALUE TABLE NO. Nw AND POINTER Pw OBTAINED FROM "LAST POINTER" REGISTER
44
JUMP IN CODE TABLE (Nw) TO LAST CODE LINE (Pw)
45
RETURN CODE ON DISPLAY
8'
D-SET-TASTE
D-SET KEY DEPRESSED
46
INITIALIZE CODE INPUT DISPLAY
47
FILL CODE INPUT REGISTER WITH "-------"
48
DIGIT DISPLAY POSITION COUNTER = 8th POSITION
49
ACTIVATE 10 KEYS AS INPUT KEYS
50
CODE INPUT REGISTER ON DISPLAY
51
DIGITS POINTS FLASH
61
DEPRESS INPUT KEY
CE-TASTE CE-KEY DEPRESSED
80'
DIGIT DISPLAY POSITION COUNTER=8th POSITION
83

CODE TABLE FOR FRANKING MACHINE SERIAL NO. 143876

OWNER: WALTER SCHMID, HAUPTSTR. 7, SAFENWIL

| C-Fr. 100 | ISSUE DATE | Vi | C-Fr. 200 | ISSUE DATE | Vi | C-Fr. 500 | ISSUE DATE | Vi |
|---|---|---|---|---|---|---|---|---|
| 11445378 | 16.11.87 | Te | 12613259 | | | 13441176 | 28.12.87 | Te |
| 21379432 | 28.12.87 | Te | 22770833 | | | 23490039 | | |
| 11152647 | | | 12023041 | | | 13895899 | | |
| 21299595 | | | 22912418 | | | 23662641 | | |
| 11269736 | | | 12476040 | | | 13417620 | | |
| 21414634 | | | 22722163 | | | 23168207 | | |
| 11074766 | | | 12516059 | | | 13312056 | | |
| 21325227 | | | 22264525 | | | 23481060 | | |
| 11471841 | | | 12270769 | | | 13626224 | | |
| 21249809 | | | 22653526 | | | 23717250 | | |

METHOD FOR FILLING THE VALVE QUANTITY MEMORY OF A FRANKING MACHINE

BACKGROUND OF THE INVENTION

The invention relates to a method for filling the value preset memory of a franking machine, whose functional sequence is controlled by a central electronic control unit, with a coded information exchange between an authorizing, remote control room and the user of the franking machine. By means of the control unit of the franking machine, an appropriate association between the exchanged information is checked. This invention also relates to a franking machine for performing the method with an electronic control unit having a computer and a memory linked with a plurality of input keys and a display field, one of the memories being a value preset memory for the value quantities to be used by franking.

According to known methods of this type, e.g. according to U.S. Pat. No. 4,097,923, the necessary information forming a pair of numbers authorizing the filling of a value preset memory of a franking machine, are calculated according to a unitary given rule for all the franking machines, i.e. according to an algorithm, both in the control room and in the franking machine. Following an information exchange with the control room, the numbers are compared with respect to possible pair formation in the franking machine. This gives an information pair valid for filling the value preset memory if the comparator of the franking machine has established that both individual information of the pair have been calculated according to the same rule. Thus, this rule forms an access code for the acquisition of new value quantities usable in the franking machine.

However, these known methods suffer from the disadvantage of a limited security against unauthorized value preset filling, because the code to the security system is valid for all the franking machines, i.e. the algorithm used as a basis for the calculation of authorizing numbers for all franking machines can be relatively easily determined by trial and error with the aid of conventional computers. The random number generators partly used in the known methods also contain a calculating rule and consequently do not supply true random numbers. Therefore, they also lead to limited security.

SUMMARY OF THE INVENTION

The present invention seeks to provide a method of the aforementioned type which, without increased apparatus expenditure, would provide greatly improved security against unauthorized filling of the value quantity memory. According to the invention, the security problem is solved in that the assembly of the coded information and their reciprocal association for providing information pairs is carried out in random manner in the form of true random numbers and the information and associations valid only for the particular franking machine are stored both in the control room and in a memory of the franking machine. The filling of the value preset memory of the franking machine is authorized when it has been established, on the basis of a program of the control unit, that the information received from the control room and entered as an input code into the franking machine for filling the value preset memory is already stored in identical form in the franking machine. Only when there is an information pair from this input code and return code, does further filling of the franking machine by the control room take place.

Since as a result of this method, both the individual information and their pairwise association are of a completely random nature, and can only be read at the control room, there is very high security against misuse.

Security can be further increased if the information pairs are provided in tabular manner in the franking machine memory and correspondingly in the control room and can only be polled in the order of the tabular classification for the filling of the value preset memory.

Several control rooms can be provided. For instance, a control room may be located at the main post office of a particular postal region. This post office would control the authorized filling of all franking machines in that particular region. The technical expenditure, an important consideration for individual smaller post offices, can be reduced in that the information pairs or their tables can be stored in the control room in the form of manuscript completed, signable sheets, as opposed to storage electronically in EDP equipment.

BRIEF DESCRIPTION

In describing the invention, reference will be made to the accompanying drawings which show:

FIG. 1 a control panel of a franking machine.

FIG. 1A the main display field for the control panel of FIG. 1 with digit field for information entry.

FIG. 1B the main display panel of FIG. 1B with seven digits entered of an eight-digit input information.

FIG. 2 part of a simplified block diagram of the central electronic control unit of the franking machine.

FIG. 3A the upper part of a flow chart of the program flow for filling the value preset memory.

FIG. 3B the lower part with respect to the flow chart of FIG. 3A.

FIG. 4 a block diagram of the linked data fields (pointers) of a non volatile RAM, as well as the code tables of a read-only memory (ROM) containing the information pairs.

FIG. 5 a representation of written code tables.

DETAILED DESCRIPTION OF THE INVENTION

Figures 1, 1A, 1B:
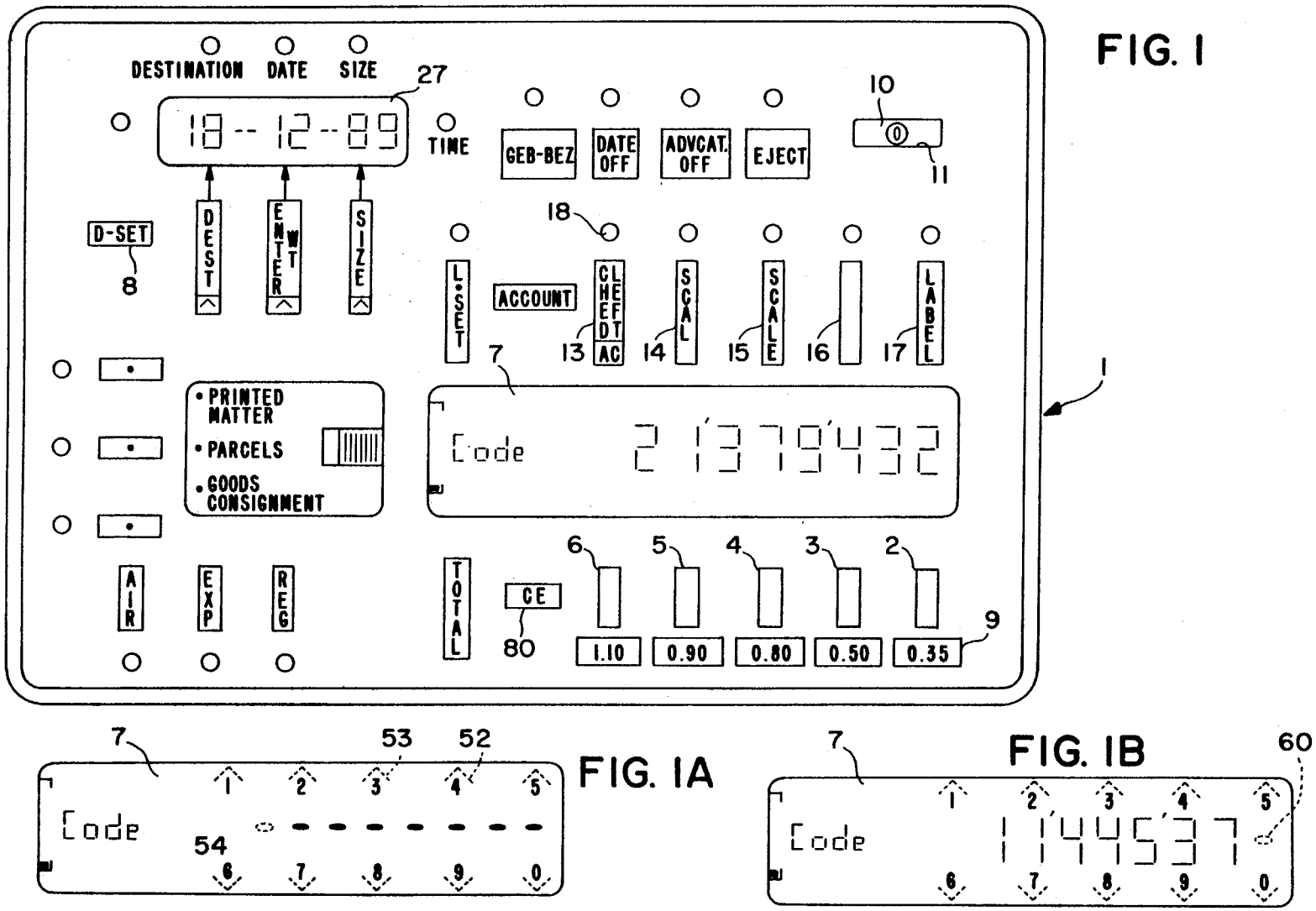

The control panel 1, shown in FIG. 1, is provided on the casing of a franking machine. The electronically controlled, electromechanical drive, as well as the function of the control panel elements thereof, are described in greater detail in U.S. Pat. Nos. 4,898,093 and 4,520,725, as well as in pending U.S. patent application Ser. Nos. 07/490,037 and 07/490,040. Those references are herein incorporated by reference. As stated therein, the input keys 2–6, located below the display or indicator panel 7, are a function of the selection of a corresponding program by means of the D-SET key 8, and are used either for the entry and electromechanical setting of fixed predetermined franking values corresponding to the associated inscriptions 9, or for the incremental advance of individual decimal figures of a franking value. The introduction of a zero key or code 10 into the key or code receptacle 11 of control panel 1 and the subsequent operation of the D-SET key 8, according to the program diagram of FIG. 3A,B, gives said input keys 2–6, a further function in that they become the keys of a tens keyboard for the entry of code figures. The five further keys of the tens keyboard are obtained through the function change of the function keys 13–17 are displayed alongside the corresponding keys on display panel 7, as shown if FIGS. 1A and 1B.

The changeable first function of the function key CRED LEFT 13 are used for polling the preset value still available for franking. A red light-emitting diode 18 positioned above this inscribed function key lights up if a value inputed for franking exceeds the remaining preset value. At this instant, the franking machine is no longer usable for franking until the value preset memory 20, depicted in FIG. 2, has been refilled.

Figure 2:
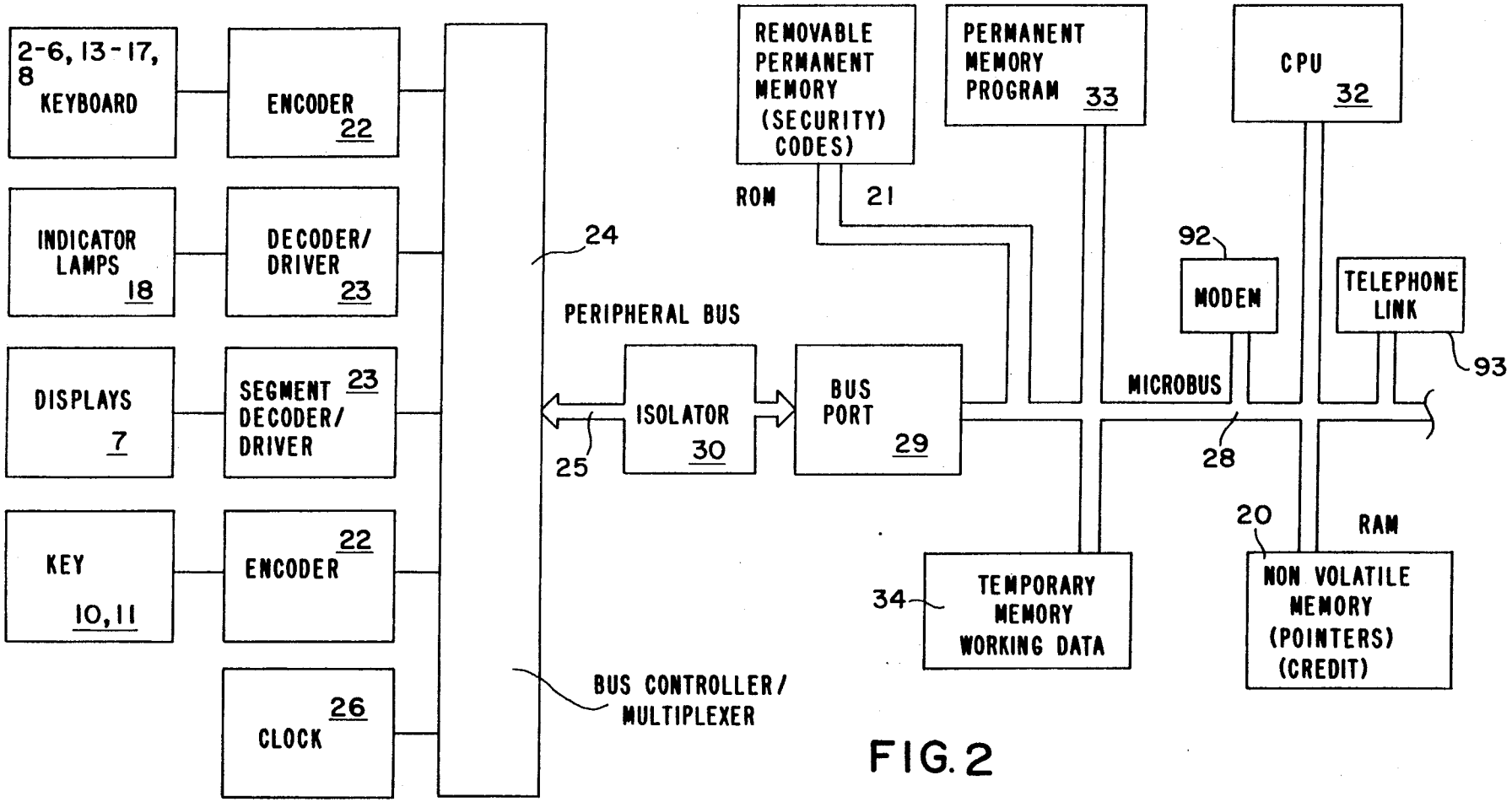

The block diagram of the central control unit according to FIG. 2 shows the aforementioned peripheral elements as blocks KEYBORD 8,2–6, 13–17, INDICATOR LAMPS 18, DISPLAYS 7, KEY 10. The signals of the function keys 8, 2–6, 13–17 and key 10 are converted by ENCODER 22 into binary word signals and fed to a BUSCONTROLLER and MULTIPLEXER 24. The latter periodically or spontaneously controls said peripheral elements, separates inputs and outputs and brings or reads the information into sequential form to or from peripheral bus 25. It can be constructed as a separate microprocessor. The display panel 7 and indicator lights (18) of control panel 1 are each operated via a DECODER/DRIVER 23, so as to be operated with the necessary electrical power on the basis of binary information. CLOCK 26 is used for time control of the date display on the second display 27 of control panel 1. The central computer bus 28 is connected across a busport 29 and a bus isolator 30 to the BUSCONTROLLER and MULTIPLEXER 24. Bus isolator 30 brings about an isolation of the signals, so that no faults pass to the computer bus 28. Bus port 29 switches the signals from the rapid computer bus 28 to the slow peripheral bus 25.

To computer bus 28 is connected to the central computer CPU 32 and several memories 20,21,33,34. The non volatile data memory RAM 20, which may be constructed as a RAM with a battery such as a NOVRAM, EEPROM or EAROM, stores intermediate results and receives the preset value usable by franking. It also has the POINTERS (FIG. 4) for polling the code tables (FIG. 4) contained in the ROM 21. The latter is enclosed in the sealed franking machine casing or is itself fixed in sealed manner. It is replaceable by a person so authorized by the post office when all or one of the available code tables have been used up. This can take place at the same time as any routine machine overhaul necessitated as a result of the long operating period of the franking machine. The fact that the code is used up is signaled on display 7 by an appropriate written indication ("out of order"), after the final POINTER, according to register 36 of the block diagram of FIG. 4, has reached the end of one of the stored code tables 38. There is also a program memory 33 in the form a ROM, PROM or EPROM for the different function programs of the franking machine. This is described in greater detail inter alia in the aforementioned U.S. patent application Nos. 07/490,037 and 07/490,040. Finally, a data memory RAM 34 is provided for temporary storage functions. It is obvious that different memories with the same characteristic, as memory fields or panels, can be present in a unitary memory chip.

So as to only permit the filling of the value preset memory 20 after previously obtaining authorization from the post office, i.e., after the amount corresponding to the desired preset value has been transferred to the relevant post office account, a coded information exchange must take place between the franking machine and the authorizing post office. For the purpose of this information exchange, it is necessary to supply the post office with a return code number stored in the ROM 21 of the franking machine and the desired preset amount to be refilled. The authorizing input code number subsequently supplied by the post office forms the key or code number for filling the value preset memory RAM 20 of the franking machine. This information exchange, e.g. in the form of an eight-digit number, can -take place in different ways, such as orally, per modem, 92 connected to the computer bus 28, by a telephone link 93 connected to the computer bus 28, or in writing.

The return code necessary to obtain the next valid input code is accessible from the franking machine in response to the inputing of an input code number from the Post Office authorizing filling from the otherwise inaccessible ROM 21 and is displayed on the display 7 of control panel 1 at will when and if the zero key 10 has been inserted in the key receptacle 11 of the franking machine. The first return code is therefore made available to the franking machine user for a subsequent filling by the said machine from its ROM 21, after the first input code number has been entered in the franking machine for the first use thereof. This first input code number can be supplied to the user at the time of purchasing the franking machine or can be entered prior to purchase for a first filling bought at the time of purchase.

Figures 4, 5:
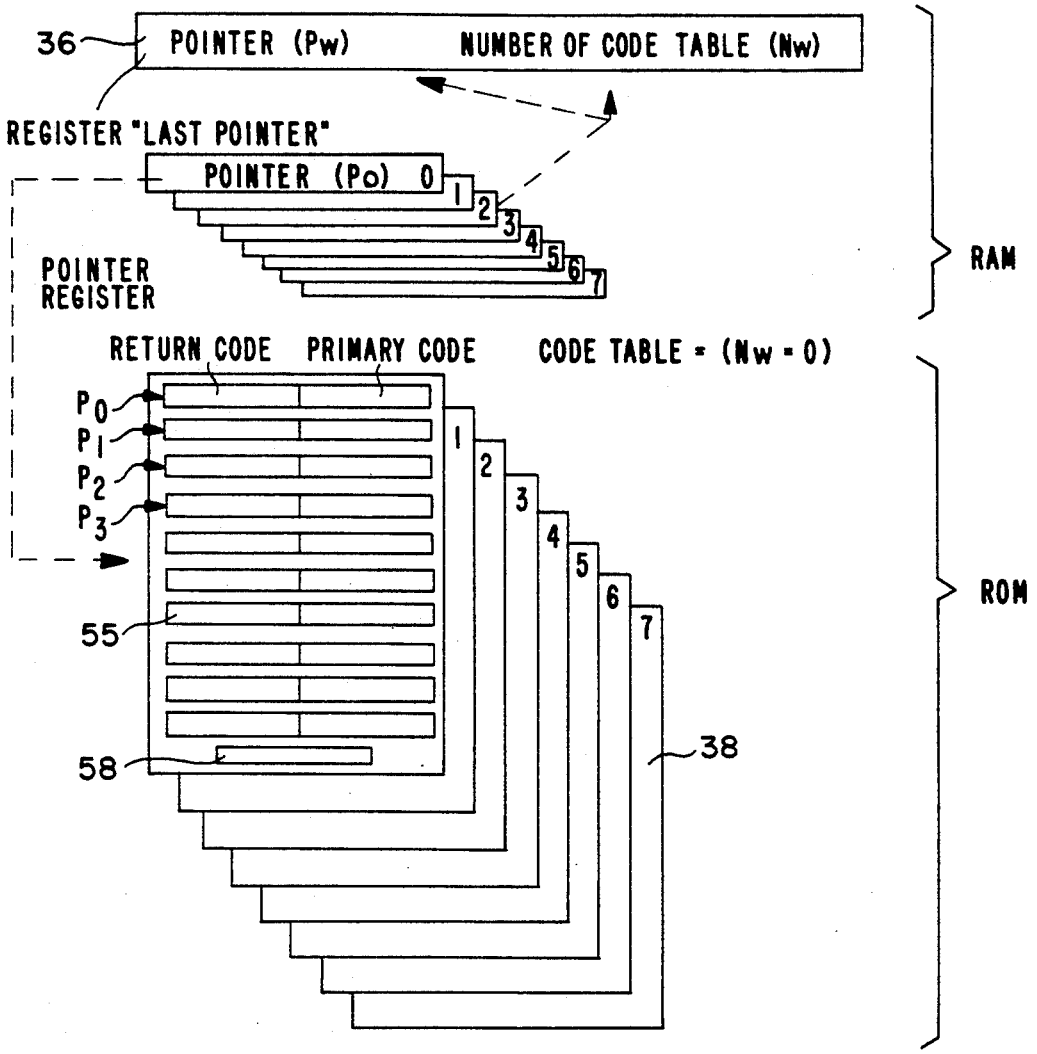

The information in the form of two eight-digit code numbers required for each filling is obtained from the return code supplied by the post office, e.g. in accordance with the number combination 21379432 shown on display 7, together with the indicated desired filling amount of, for example, 500 Francs and the new input code number corresponding to the desired filling amount and taken at the post office from the table relating to the particular franking machine in accordance with FIG. 5. According to this table, the input code number necessary for a 500 Franc filling is the same as the number combination 13441176. According to the table of FIG. 5, the new return code number automatically displayed by the franking machine for subsequent further filling after filling by said amount has taken place corresponds to the number combination 23490039. This return code number is used for comparison with the return code number released by the franking machine or for identification purposes, if the user subsequently requires a further filling amount for his franking machine and this is not supplied by the post office.

By means of the flow chart of FIG. 3A,B, a more detailed description will now be given of the program sequence of the central electronic unit (FIG. 2) on filling its value preset memory. The program path via a transition point indicated by a circle 40 always takes place if the information associated with the particular branch, e.g. key 0, does not apply.

In accordance with the flow chart, the complete program passage according to branch 41 first presupposes the presence of the key 10 with number 0, i.e. this must be indicated via key receptacle 11 of control panel 1 to the control unit according to FIG. 2. The display 7 is then initialized in preparation to display the return code as indicated by function field 90. According to branch 42, the PENALTY timer must have the value zero. According to the bottom part of the flow chart, the PENALTY timer only comes into operation following a complete incorrect inputing of a code input number. By doubling the time sequence in the case of incorrect inputing, it prevents trial and error by numerous inputing actions. According to function fields 43,44, the last pointer position Pw in a table Nw is obtained from the register "LAST POINTER" (FIG. 4), by jumping to the code line according to the last pointer position Pw in order on in order to obtain on display 7, indicated by function field 45, the old return code which is necessary for obtaining an authorizing input code.

Figure 3B:
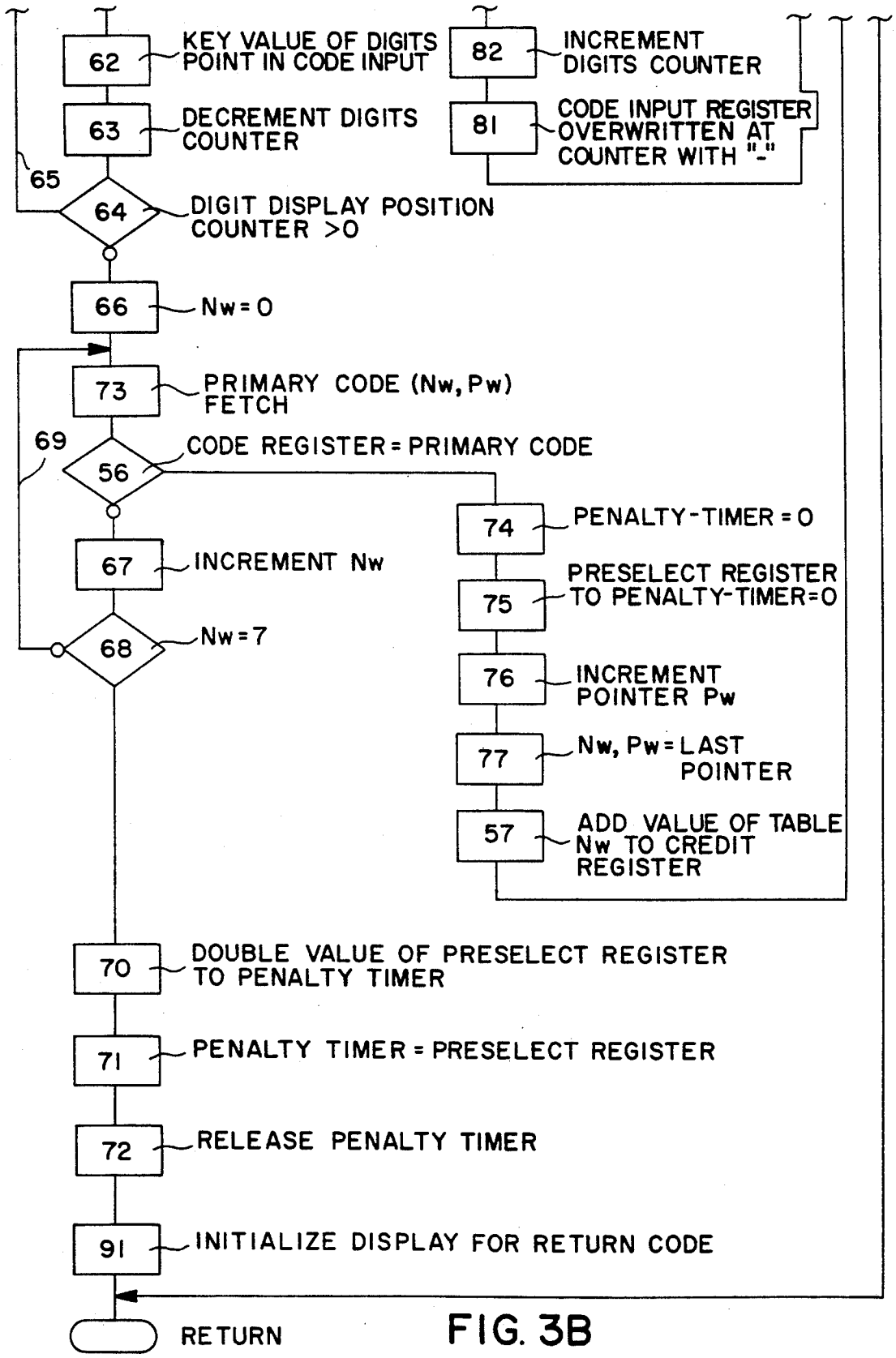

In order to be able to input the input code obtained from the post office, the code input function is activated by depressing the D-SET key 8 shown in FIG. 3A at function field 8' following the insertion of key 0 according to function fields 46 to 51 such that, upon initializing the code input display (function field 46), the code input register is filled with dashes (function field 47), and the 8th position is referenced by operation of the digit display position counter according to function field 48. The result of this is that, according to function fields 49 to 51, on display 7 appears ten flashing or blinking arrows 52 with the value figures 53 of the tens keyboard 2–6, 14–17 and eight dashes "--------", indicating the free locations for the code numbers to be inputed. The left hand dash 54, in the row of dashes, flashes first, as indicated by broken line in FIG. 1A. This means that the digit display position counter is at the eighth position (counter=8), and the program is ready for the code input beginning at this point.

For each of the eight code tables Nw=0 to Nw=7, the pointer register (FIG. 4) of the non volatile RAM 20 stores a pointer Pw, which indicates the next code line 55, which has not yet been used for filling with the pointer numbers 0,1,2,3, etc. The pointer registers are in each case called with the number Nw of the code table. The lines 55 contained in each of the code tables have in each case a return code and a primary code. The latter can be found by a program-based searching of all the stored tables Nw and is to be compared with the input code until at branch 56 the primary code stored in the code register coincides with said input code. Then, according to function field 57, the value 58 corresponding to code table Nw can be added in the value preset register 20.

The input of the input code number starts with the digit "1", because each input code number has as the first position a "1", whilst each return code number begins with a "2". This is a suggested but not the only manner of distinguishing between return and input codes. For this purpose, key 13, of control panel 1 positioned alongside the "1" imaged in display 7, is to depressed. The table number Nw corresponding to the desired filling amount is then entered. Corresponding to the table of FIG. 5, digit "1" is to be entered for the filling amount 100 Francs. The number sequence 445378 following this, according to the table, s then entered. FIG. 1B shows display 7 prior to the entry of the last digit "8" of this example. The "-" flashes at the point 60 still to be completed. Branch 61 corresponds to the program location where an input key 2–6, 13–17 is to be depressed. According to function field 62, the key value passes into the code input register and at the subsequent function field 63 corresponding to the reduced number of free digit locations "-" is reduced in a digit counter. As a result of branch 64, the programmer continues along the returning program loop 65 and over function fields 50,51,61–64 in the same way, until there is no further free digit location "-" and consequently eight digits 11445378 have been entered.

When the input code has been completely entered or inputed, then the code tables Nw according to function field 73 are investigated for the primary code having this number. This starts, according to function field 66, with table Nw=0. If the primary code is not found in the particular table Nw and consequently the condition "code register=primary code" of branch 56 is not fulfilled, then according to function field 67 "Increment Nw" the next table Nw is fetched so as to be investigated. This continues according to branch 68 and the returning program loop 69 the eighth table Nw=7 has been investigated without fulfilling the condition of branch 56 or without finding the appropriate primary code. In this case, there is an incorrect or faulty input and the input program is interrupted by the PENALTY timer for a certain time in accordance with function fields 70 to 72. Following release, display 7 is initialized and the previous return code again appears on display 7, according to function field 91, and inputing can be recommenced. If the inputed eight-digit number is again not found as a primary code number in a table Nw of ROM 21, the interrupt or PENALT time is in each case doubled.

If at branch 56 the identity between the inputed code number 11445378 and the primary code number is established, then the PENALTY timer is reset to zero according to function fields 74,75 following a possible preceding incorrect input. If the present pointer number (Pw) is increased by one value (field 76) and is stored as a new pointer in register 36 "LAST POINTER", together with the associated table number, (Nw (field 77), then this new code number is used for additional filling purposes. That is, the preset value 58 of the selected table Nw is added in the value preset register (20) and the new return code (associated with the new "Last Pointer") to be used for subsequent fillings appears on display 7, for as long as the key with the number "0" remains in the key receptacle 11 of the control panel. Another key may be used for franking purposes and several of these can be provided as a function of the number of users. The construction of the keys is described in U.S. Pat. No. 4,788,623.

If on branch 61, the CE(Clear Entry)-key 80 is depressed, shown at function field 80', in place of the input key 2–6,13–17, then the inputed number disappears at the particular number location, in that according to function field 81, once again a blank "-" is overwritten there. At function field 82 the amended number of the numbers to be inputed is recorded in the digits counter. However, the program is returned to function field 50, if according to the previous branch 83 there are already eight number locations "--------" free.

The drawings and the foregoing description are not intended to represent the only form of the invention in regard to the details of its construction and manner of operation. Changes in form and in the proportion of parts, as well of substitution of equivalents, are contemplated as circumstances may suggest or render expedient; and although specific terms have been employed, they are intended in a generic and descriptive sense only and not for the purpose of limitation, the scope of the invention being delineated in the following claims:

What is claimed is:

1. A method for filling the value preset memory of a franking machine, whose functional sequence is controlled by a central electronic control unit in the franking machine in accordance with a coded information exchange between an authorizing remote control room and the user of the franking machine, in which by means of the control unit of the franking machine an appropriate association between the exchanged information is checked, said method comprising the steps of:

creating a series of coded information pairs, each code in said pairs of codes being in the form of true random numbers, each information pair comprising a first code associated with an input code to be inputted and a second code defining a return code, and each said series of coded information pairs being unique to a particular franking machine;

storing said series of information pairs, valid only for said particular franking machine, both in the remote control room and in a memory of said particular franking machine;

entering an input code received from the remote control room into said particular franking machine;

comparing the entered input code with said stored first codes; and upon a successful comparison in said comparing step, filling the value preset memory in said particular franking machine with a value associated with the entered input code, and outputting said return code paired with said first code for use in a subsequent filling of the franking machine.

2. The method according to claim 1, wherein the coded information to be supplied by the control room to the franking machine user is read out of a table having the information pairs in written form.

3. The method according to claim 1, wherein each said code in said pairs of codes includes a number located at a predetermined digit position which identifies one of several possible value quantities available for filling said value preset memory.

4. The method according to claim 1, wherein each said code in said pairs of codes includes a number located at a predetermined digital position which identifies whether the code of the information pair is of the first code type or the second code type.

5. The method according to claim 1, wherein said information pairs are organized in tabular arrangement at the control room, an individual table being provided for each given, fillable value quantity.

6. The method according to claim 5, wherein only the input code of the information pair following, in the table, the information pair used for the preceding filling can be used for additional filling purposes.

7. An apparatus for filling the value preset memory of a franking machine, whose functional sequence is controlled by a central electronic control unit in the franking machine in accordance with a coded information exchange between an authorizing remote control room and the user of the franking machine, in which by means of the control unit of the franking machine an appropriate association between the exchanged information is checked, the information comprising a series of coded information pairs, each code in the pairs of codes being in the form of true random numbers, each information pair comprising a first code associated with an input code to be inputted and a second code defining a return code, and each said series of coded information pairs being unique to a particular franking machine, said electronic control unit comprising:

a computer;

a plurality of memories;

a plurality of input keys; and a display; wherein one of said memories is a value preset memory for storing the value quantities to be used during franking, and wherein said electronic control unit further comprising a read-only memory which stores several of said information pairs.

8. The franking machine according to claim 7, wherein at least ten of said keys are arranged along the display and have multiple function for command inputs to said electronic control unit, said control unit comprising at least one command input means provided for setting up the function of filling the value preset memory, and for modifying the function of the keys so that they form a tens keyboard for inputting a coded information in the form of a multiple-digit code number, the key values (0–9) being displayed alongside a corresponding key on the display.

9. The franking machine according to claim 7, wherein the information pairs are present in tabular, predetermined order in said read-only memory and can only be polled in this order for filling said value preset memory.

10. The franking machine according to claim 9, wherein the information pairs are stored in several tables, there being one table for each of the different predetermined value quantities to be filled.

11. A method for filling the value preset memory of a franking machine, whose functional sequence is controlled by a central electronic unit with the franking machine in accordance with a coded information exchange between an authorizing, remote control station and a user of the franking machine, said method comprising the steps of:

(a) creating a particular series of random numbers, said random numbers comprising a sequence of digits referred to as a code, said series of random numbers comprising return codes and associated authorized input codes;

(b) communicating a first return code to the control station;

(c) matching said first return code to a code stored at the control station;

(d) after said matching step, obtaining an authorized input code from the control station;

(e) inputting said authorized input code into the franking machine;

(f) comparing said authorized input code with a number of codes in the franking machine;

(g) after said comparing step results in finding an identical code in the franking machine the same as said authorized input code, filling the memory of the franking machine with a preset value.

12. The method as claimed in claim 11 further comprising the following steps before said communicating step:

first, storing said particular series of random numbers in the memory of the franking machine; and second, storing said particular series of random numbers at the control station.

13. The method as claimed in claim 11 further comprising, after step (g), the step of displaying a second return code to be used for said communicating step.

14. A method as claimed in claim 11 wherein said communicating and obtaining steps are carried out by telephone link.

15. As method as claimed in claim 11 wherein said communicating and obtaining steps are carried out by modem.

16. A method as claimed in claim 11 wherein said communicating and obtaining steps are carried out by oral means.

17. The method as claimed in claim 11 wherein in said designating step, return codes and said authorized input codes are stored in tabular arrangement at the control room, an individual table being provided for each given, fillable preset value.

18. The method as claimed in claim 11 wherein each of said random number includes a digit located at a predetermined digit position and determines one of several possible quantities given for said filling step.

19. The method as claimed in claim 11 wherein each of said random number includes a digit located at a predetermined digit position to identify whether said code is a return code or an authorized input code.

* * * * *